US008410694B2

(12) United States Patent
Matsushita et al.

(10) Patent No.: US 8,410,694 B2
(45) Date of Patent: Apr. 2, 2013

(54) PLASMA DISPLAY PANEL

(75) Inventors: Mitsuhito Matsushita, Chiba (JP); Takashi Sasaki, Hiratsuka (JP); Fumiaki Yoshino, Kashiwa (JP)

(73) Assignee: Hitachi, Ltd., Tokyo (JP)

( * ) Notice: Subject to any disclaimer, the term of this patent is extended or adjusted under 35 U.S.C. 154(b) by 360 days.

(21) Appl. No.: 12/681,107

(22) PCT Filed: Oct. 1, 2007

(86) PCT No.: PCT/JP2007/069204

§ 371 (c)(1),
(2), (4) Date: May 19, 2010

(87) PCT Pub. No.: WO2009/044445

PCT Pub. Date: Apr. 9, 2009

(65) Prior Publication Data

US 2010/0244683 A1 Sep. 30, 2010

(51) Int. Cl.
*H01J 17/49* (2006.01)

(52) U.S. Cl. ..... 313/582; 445/24; 445/25; 313/583

(58) Field of Classification Search ..... 313/582–587; 445/24–25

See application file for complete search history.

(56) References Cited

U.S. PATENT DOCUMENTS 5,998,935 A * 12/1999 Marcotte ..... 315/169.4
6,288,488 B1 * 9/2001 Amemiya ..... 313/582
6,333,599 B1 12/2001 Kawanami et al.
6,577,056 B1 * 6/2003 Chang ..... 313/493
6,670,754 B1 12/2003 Murai et al.
6,819,046 B2 * 11/2004 Hirano ..... 313/582
2006/0267499 A1 11/2006 Yoo et al.
2007/0285012 A1 * 12/2007 Bae ..... 313/582

FOREIGN PATENT DOCUMENTS

JP 11-212515 A 8/1999
JP 2001-052623 A 2/2001
JP 2006-339142 A 12/2006
JP 2007-094301 A 4/2007

* cited by examiner

*Primary Examiner* — Mary Ellen Bowman
(74) *Attorney, Agent, or Firm* — Miles & Stockbridge P.C.

(57) ABSTRACT

To provide a plasma display panel that can improve the bright room contrast.

The PDP of the present invention provided with a discharge space formed between a front-side substrate assembly and a rear-side substrate assembly, wherein the front-side substrate assembly has a plurality of display electrodes for defining lines of a screen, and the rear-side substrate assembly has a plurality of barrier ribs for partitioning the discharge space in a column direction, and a phosphor layer that is applied to side surfaces and a bottom surface of each of grooves formed between the barrier ribs, the plasma display panel is characterized in that each of the display electrodes for defining the lines comprises a belt-like base portion that extends over an entire length of the screen in a line direction, and a plurality of projections that projects from the base portion toward another display electrode adjacent thereto, each projection having a width the same as or narrower than a width of a bottom of the phosphor layer, and having a visible light transmittance ranging from 0% to 80% inclusive.

6 Claims, 10 Drawing Sheets

(a)

(b)
I—I cross-sectional view

PLASMA DISPLAY PANEL

TECHNICAL FIELD

The invention relates to a plasma display panel (PDP) used for display devices and the like.

BACKGROUND ART

At the present, the type of AC-driven PDPs which are generally commercialized is the type of surface discharge PDP. In the type of surface discharge PDP, phosphors formed on the rear-side substrate are allowed to emit light, and a displaying process is carried out through an optical filter placed on the front-side substrate. Although the optical filter is prepared so as to weaken reflected light, the optical filter also weakens the light emission from the phosphors simultaneously.

Patent Document 1 has disclosed a PDP in which at least one portion of the front-side substrate or the filter is colored so that this color is subtraction-mixed with a color demonstrated by a discolored dielectric layer covering the electrodes on the front-side substrate to provide a black color; thus, the PDP can reduce externally-incident light reflected light and subsequently improve bright room contrast.

Patent Document 1: JP-A No. 2006-339142

DISCLOSURE OF THE INVENTION

Problems to be Solved by the Invention

However, in order to carry out the method of Patent Document 1, special substrates and complicated manufacturing processes are required. Therefore, there have been strong demands for a technique that can improve the bright room contrast by using an easy method.

In view of the circumstances, it is an object of the present invention to provide a PDP that can improve the bright room contrast.

Means for Solving the Problems and Effects of the Invention

The PDP of the present invention is a plasma display panel provided with a discharge space formed between a front-side substrate assembly and a rear-side substrate assembly, wherein the front-side substrate assembly has a plurality of display electrodes for defining lines of a screen, and the rear-side substrate assembly has a plurality of barrier ribs for partitioning the discharge space in a column direction, and a phosphor layer that is applied to side surfaces and a bottom surface of each of grooves formed between the barrier ribs, wherein the plasma display panel is characterized in that each of the display electrodes for defining the lines comprises a belt-like base portion that extends over an entire length of the screen in a line direction, and a plurality of projections that projects from the base portion toward another display electrode adjacent thereto, wherein each projection has a width the same as or narrower than a width of a bottom of the phosphor layer, and each projection has a visible light transmittance ranging from 0% to 80% inclusive.

The present inventors have made earnest investigations and thus have found that, by making the width of the projection of the display electrode the same as or narrower than the width of the bottom of the phosphor layer and also setting the visible light transmittance of the projection in a range from 0% or more to 80% or less, the bright room contrast can be improved, and have completed the present invention. The functions are explained as follows:

In a light emission profile of the discharge cell in a line direction (lateral direction), the light emission intensity is high near the barrier rib in the column direction and low in the center of the discharge cell. The reflected light of the PDP is mainly composed of externally-incident light reflected light on the phosphor layer. The externally-incident light reflected light is derived from light that is made incident from outside and randomly reflected inside the discharge cell and is then released onto the display surface side; therefore, in the profile of the externally-incident light reflected light, the reflected light intensity is virtually uniform inside the discharge cell. Therefore, by making the width of the projection of the display electrode the same as or narrower than the width of the bottom of the discharge cell, the visible light transmittance of the projection is made lower than the conventional value, more specifically to 0% or more to 80% or less, so that the intensity of externally-incident light reflected light can be made much lower than the light emission intensity, thereby improving the bright room contrast. Moreover, by increasing the visible light transmittance of the optical filter placed on the front side of the front-side substrate, the light emission intensity can be enhanced while maintaining the intensity of the externally-incident light reflected light in the same level as that of the prior art.

Furthermore, the present invention makes it possible to more easily improve the bright room contrast in comparison with the method disclosed in Patent Document 1.

Hereinafter, various embodiments of the present invention will be exemplified.

Each display electrode may have a translucent electrode that constitutes the projections and has a visible light transmittance ranging from 10% to 80% inclusive, and a metal electrode that constitutes the base portion.

The translucent electrode may be formed by reducing a patterned transparent conductive material layer.

The translucent electrode may be made of a transparent conductive material containing an impurity, and the impurity is contained therein so that the visual light transmittance of the translucent electrode is ranges from 10% to 80% inclusive.

The translucent electrode may be provided with a transparent conductive material layer and a metal layer laminated on the transparent conductive material layer, and the metal layer may have a thickness that allows the visual light transmittance of the translucent electrode to range from 10% to 80% inclusive.

The front-side substrate assembly may be further provided with an optical filter on its front side, which has a visible light transmittance ranging from 30 to 70% inclusive.

The various embodiments exemplified herein may be combined with one another.

DESCRIPTION OF THE REFERENCE NUMERALS

Figure 1:
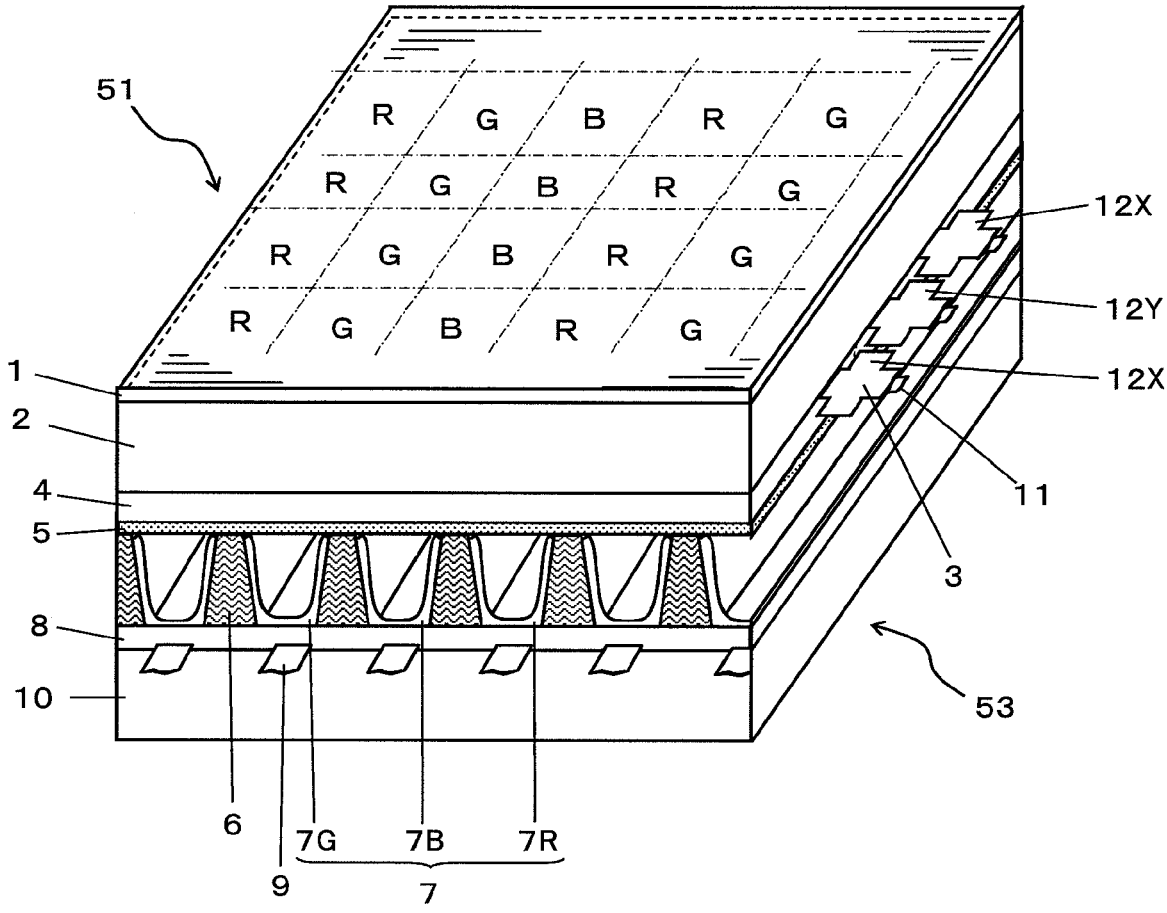
FIG. 1 is a perspective view illustrating a configuration of PDP in accordance with an embodiment of the present invention.

1: optical filter
2: front-side substrate
3: translucent electrode
3a: base portion of translucent electrode
3b: projection of translucent electrode
4: dielectric layer of front-side substrate assembly
5: protective layer
6: barrier ribs
7: phosphor
7R: red phosphor
7G: green phosphor
7B: blue phosphor
8: dielectric layer of rear-side substrate assembly
9: address electrode
10: rear-side substrate
11: metal electrode
11a: base portion of metal electrode
11b: projection of metal electrode
12: display electrode
51: front-side substrate assembly
52: rear-side substrate assembly
13: address driving circuit
14: scan driver
15: Y-driving circuit
16: X-driving circuit
17: control circuit
18: 1 field
19: sub-field
20: reset period
21: address period
22: discharge maintaining period
23: X-voltage
24: X-compensation voltage
25: X-voltage
26: first sustain pulse
27: repetitive sustain pulse
28: repetitive sustain pulse
29: repetitive sustain pulse
30: Y-writing dull wave
31: Y-compensation dull wave
32: scanning pulse
33: first sustain pulse
34: repetitive sustain pulse
35: repetitive sustain pulse
36: repetitive sustain pulse -continued

DESCRIPTION OF THE REFERENCE NUMERALS

37: scanning pulse
38: Y-writing dull wave
39: Y-compensation dull wave
40: scanning pulse
41: first sustain pulse
42: repetitive sustain pulse
43: repetitive sustain pulse
44: adjusting pulse for number of times of discharge
45: address pulse
46: address pulse

BEST MODE FOR CARRYING OUT THE INVENTION

Hereinafter, an embodiment of the present invention will be described by use of the drawings. The contents shown in the drawings and the following description are exemplification, and the scope of the present invention is not limited to the contents shown in the drawings and the following description. Hereinafter, the present invention will be described taking an AC-driven three-electrode surface-discharge PDP for color display as an example.

1. PDP

Figure 2:
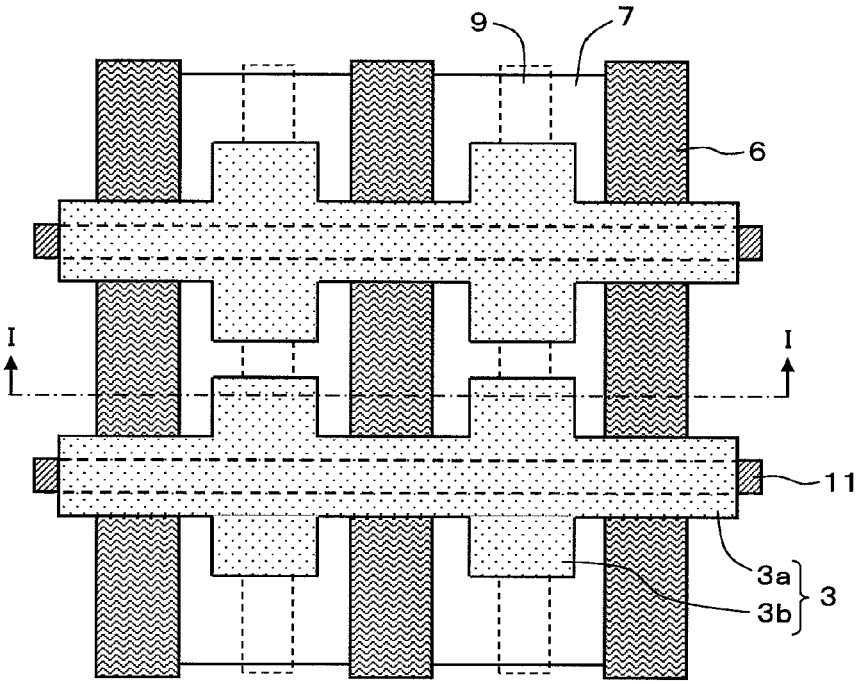
FIG. 2(*a*) is a plan view illustrating a configuration of PDP in accordance with an embodiment of the present invention, and FIG. 2(*b*) is an I-I cross-sectional view of FIG. 2(*a*).
Figure 2:
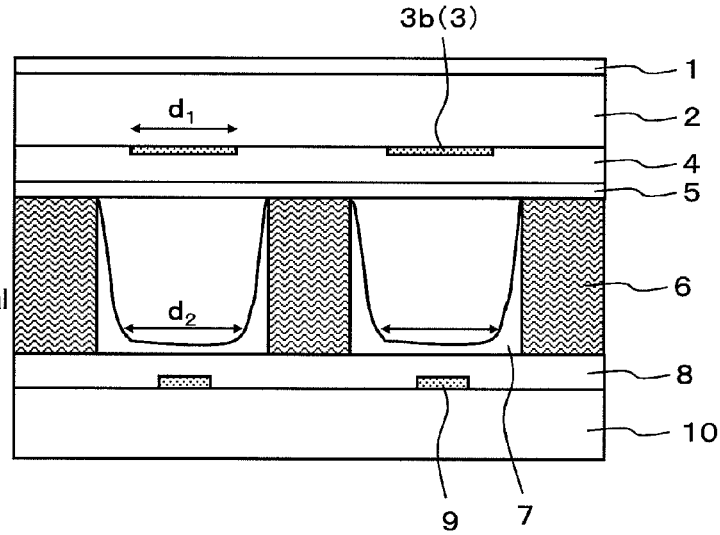

Referring to FIG. 1 as well as FIGS. 2(*a*) and 2(*b*), a PDP in accordance with an embodiment of the present invention will be described. FIG. 1 is a perspective view illustrating a configuration of the PDP in accordance with an embodiment. FIG. 2(*a*) is a plan view illustrating the configuration of the PDP in accordance with the embodiment, and FIG. 2(*b*) is an I-I line cross-sectional view of FIG. 2(*a*). In FIG. 2(*a*), for convenience of illustration, one portion of the configuration is omitted.

The PDP of this embodiment comprises a front-side substrate assembly 51 and a rear-side substrate assembly 53 opposed to each other sandwiching discharge spaces formed to seal a discharge gas.

The front-side substrate assembly 51 comprises a plurality of display electrodes (also called to "sustaining electrodes") 12X and 12Y that define lines of a screen on the front-face substrate 2, a dielectric layer 4 that covers the display electrodes 12X and 12Y and a protective layer 5 formed on the dielectric layer 4. Moreover, the front-side substrate assembly 51 comprises an optical filter 1 on the front side of the front substrate 2.

The rear-side substrate assembly 53 comprises a plurality of address electrodes 9 (also called to "data electrodes") that are disposed on a rear-side substrate 10 in a direction intersecting with the display electrodes, a dielectric layer 8 covering the address electrodes 9, barrier ribs 6 disposed on the dielectric layer 8 of two sides of each address electrode 9, and a phosphor layer 7 formed on the surface of the dielectric layer 8 and both side surfaces of the barrier ribs 6.

Each of the display electrodes 12X and 12Y comprises a belt-like base portion that is extended over the entire length of the screen in a line direction, and a plurality of projections that project toward another display electrode adjacent thereto from the base portion. The projections of the display electrode define columns on the screen together with the address electrodes so that light-emitting units, each forming a cell unit, are formed. The width of each projection is the same as or narrower than the width of the bottom of the phosphor layer 7. Moreover, the projections of each display electrode are designed to have a visible light transmittance in a range from 0% or more to 80% or less.

Hereinafter, each of constituent elements will be described in detail.

1-1. Front-side Substrate, Display Electrodes, Dielectric Layer, Protective Layer, Optical Filter (Front-Side Substrate Assembly)

A variety of the front-side substrate 2 is not particularly limited, and for example, the front-side substrate 2 is a transparent substrate such as a glass substrate and the like.

In the inner side of the front-side substrate 2, there are arranged a plurality of display electrodes 12X and 12Y both horizontally extended and arranged in parallel. Each display line (each line of the screen) is a space between the neighboring display electrodes 12X and the display electrodes 12Y. This type of PDP is the so-called ALIS structure where the display electrodes 12X and 12Y are equally spaced and all regions between the neighboring electrodes 12X and 12Y become the display lines; however, the present invention can be applied to another type of PDP where a pair of display electrodes 12X and 12Y is separated by a non-discharge interval (a non-discharge gap). The display electrodes 12X and 12Y will be described later in detail.

The dielectric layer 4 is formed on the display electrodes 12X and 12Y so as to cover the display electrodes 12X and 12Y. The dielectric layer 4 can be formed by applying a frit paste mainly made of a low melting point glass powder onto the front-side substrate 2 by a screen printing method, and then burning the fit paste. Also, the dielectric layer 4 can be formed by pasting a sheet-like dielectric layer and burning. Furthermore, the dielectric layer 4 may be formed by depositing silicon oxide ($SiO_2$) by a plasma CVD process.

The protective film 5, used for protecting the dielectric film 4 from ion impact due to the discharge during displaying, is formed on the dielectric layer 4. The protective film 5 is made of a material that has a high electron emitting coefficient upon collision with ions, and is mainly made of MgO. The protective film 5 may be formed by using a known thin-film forming process in the corresponding field, such as an electron beam vapor deposition process and a sputtering method.

An optical filter 1 having a visible light transmittance in a range from 30 to 70% is placed on the front side of the front substrate 2. Light generated in the discharge space is observed after once having passed through the optical filter 1, while reflected light derived from externally-incident light reflected by the phosphor layer 7 is observed after having passed through the optical filter 1 twice. Therefore, when the optical filter 1 is disposed, the reflected light intensity is greatly attenuated in comparison with the light emission intensity, thereby improving the bright room contrast. The optical filter may be pasted to the front substrate 2, or may be pasted to another substrate and placed on the front side of the substrate 2. More specifically, the visible light transmittance of the optical filter is for example, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, or 70%. The visible light transmittance of the optical filter 1 may be in a range between any two of the numeric values described above. In the present invention, "visible light transmittance" means an average value of transmittances of light rays ranging from 500 to 600 nm.

1-2 Rear-side Substrate, Address Electrode, Dielectric Layer, Barrier Rib, Phosphor Layer (Rear-side Substrate Assembly)

A variety of the rear-side substrate 10 is not particularly limited, and, for example, the rear-side substrate 10 is a transparent substrate such as a glass substrate.

On the inner side of the rear-side substrate 10, a plurality of address electrodes 9 are horizontally in the crossing direction with the display electrodes 12X and 12Y, and the dielectric layer 8 is formed for covering the address electrodes 9. The address electrodes 9 are provided for forming address discharges to select emission cells at the intersections between the projections of the display electrodes 12Y, and the address electrodes 9 may be formed of, for example, a Cr/Cu/Cr three-layer laminate structure.

Otherwise, the address electrodes 9 may be composed of metals such as Au, Al, Cu, Cr or the like. With respect to Ag and Au, the address electrodes 9 may be formed by a thick film formation technique such as a screen printing method, and with respect to the other metals, the address electrodes 9 may be formed by a thin film formation technique such as a vapor deposition method or sputtering method, and an etching technique, so that a predetermined number of address electrodes may be deposited in a predetermined thickness, width and interval.

The dielectric layer 8 of the rear-side substrate 53 can be formed with the same material and by the same method as in the dielectric layer 4 of the front-side substrate 51.

A plurality of barrier ribs 6 are formed on the dielectric layer 8 between the two neighboring address electrodes 9 for partitioning a discharge space, for each of the columns of the screen. The shape of the barrier ribs 6 in this embodiment is a stripe. The shapes of the barrier ribs 6 may be meander shapes, or lattice shapes or ladder shapes that partition the discharge space by a cell.

The barrier ribs 6 may be formed by a sandblasting method or a photo-etching method. For example, the barrier ribs 6 can be formed in the sandblasting method by applying a frit paste composed of a glass frit having a low melting point, a binder resin and a solvent onto the dielectric layer 8, drying the frit paste, spraying cutting particles under the condition that a cutting mask having an opening of a pattern or barrier ribs is placed on this frit paste layer, cutting a frit paste layer exposed from the opening of the cutting mask, and further burning it. The barrier ribs 6 can be formed in the photo-etching method using a photosensitive resin as the binder resin and then exposure and development using a mask, and burning it, in place of cutting with the cutting particles.

At the sides and the bottom of a groove formed between the adjacent barrier ribs 6, phosphor layers 7R, 7G and 7B of red (R), green (G) and blue (B), respectively, are formed. The phosphor layers 7R, 7G and 7B can be formed by applying a phosphor paste containing a phosphor powder, a binder resin and a solvent to each of grooves between the barrier ribs by a screen printing method or a method using a dispenser, repeating this application for each of the colors, and burning it.

It is possible that the phosphor layers 7R, 7G and 7B may be formed by using a sheet-like phosphor layer material (the so-called green sheet) containing a phosphor powder, a photosensitive material and a binder resin, and using a photolithography technique. In this case, a predetermined color sheet may be adhered to the entire display area, and this may be light exposed and developed, repeatedly, by the number of the respective colors, so that the phosphor layers 7 of the respective colors may be formed between the corresponding barrier ribs 6.

Figure 3:
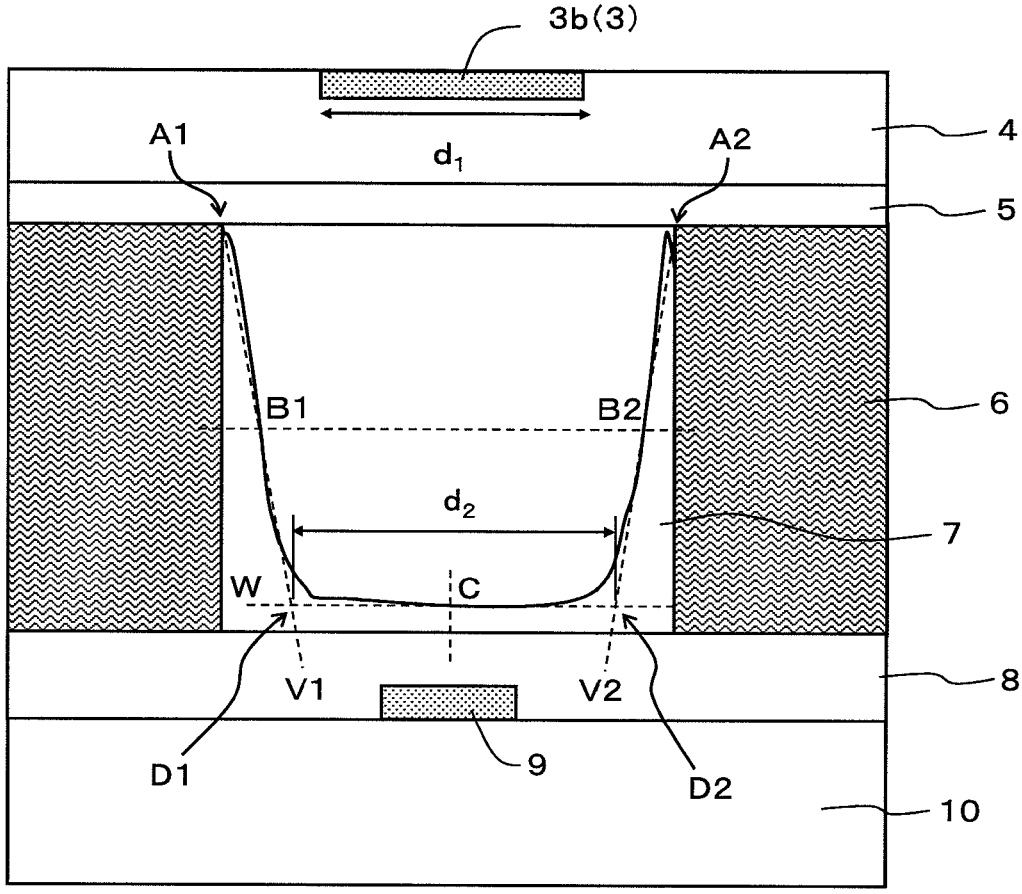
FIG. 3 is a cross-sectional view corresponding to FIG. 2(*b*) that explains "a width on the bottom of a phosphor layer" in the present invention.

The width on the bottom of the phosphor layer 7 is indicated by $d_2$ in FIG. 2(*b*). In the present invention, the width $d_2$ on the bottom of the phosphor layer 7 corresponds to a distance between points D1 and D2 in FIG. 3. Points D1 and D2 can be found by using the following method. First, in the cross-sectional view of FIG. 3, straight lines V1 and V2 are drawn so as to respectively pass through points A1 and A2 corresponding to the ends of an apex portion of each the barrier ribs 6 and points B1 and B2 corresponding to the surfaces of the phosphor layer 7 in the center of the barrier rib 6 in the height direction. Next, a straight line W is drawn so as to pass through point C corresponding to the surface of the phosphor layer 7 in the center of the adjacent barrier ribs 6 and also so as to be in parallel with the surface of the rear substrate 10. The intersection point between each of the straight lines V1 and V2 and the straight line W is defined as each of the points D1 and D2.

The front-side substrate assembly 51 and the rear-side substrate assembly 53 are confronted so that the display electrodes 12X and 12Y cross the address electrodes 9, and the surroundings are sealed to finalize a PDP by fulfilling a discharge gas containing a Ne gas as a main component and Xe within the discharge space surrounded by the barrier ribs 6. In this type of PDP, a discharge space at each of the intersections between the display electrodes 12X and 12Y and the address electrodes 9, forms a single discharge cell (unit emission region) defined as a minimum unit of display. A single pixel is composed of three cells of R, G and B.

2. Detailed Description of Display Electrodes

The following description will discuss the display electrodes 12X and 12Y in detail.

Each of the display electrodes 12X and 12Y comprises a translucent electrode 3 and a metal electrode 11. This translucent electrode 3 is formed by a pattern that integrally includes a belt-like base portion 3*a* that is extended in a line direction of a screen and a projection 3*b* that projects from the base portion 3*a* toward another display electrode adjacent thereto. The base portion 3*a* is overlapped with the belt-like metal electrode 11, and electrically connected to the metal electrode 11. A discharge is generated at a portion where the projections 3*b* that project from the respective base portions 3*a* of the adjacent two translucent electrodes 3 are opposed to each other, and the gap between the opposed two projections 3*b* forms a discharge gap.

In this structure, the base portion 3*a* of the translucent electrode 3 and the metal electrode 11 correspond to "the base of a display electrode", and the projection 3*b* of the translucent electrode 3 corresponds to "the projection of the display electrode." In the present invention, "the width of the projection of the display electrode" means a portion having the widest width of the projection. The width of the projection of the display electrode is indicated by $d_1$ in FIG. 2(*b*) and the like. In the structure as shown in FIG. 2(*a*), the width of the projection 3*b* corresponds to "the width of the projection of the display electrode."

Figure 4:
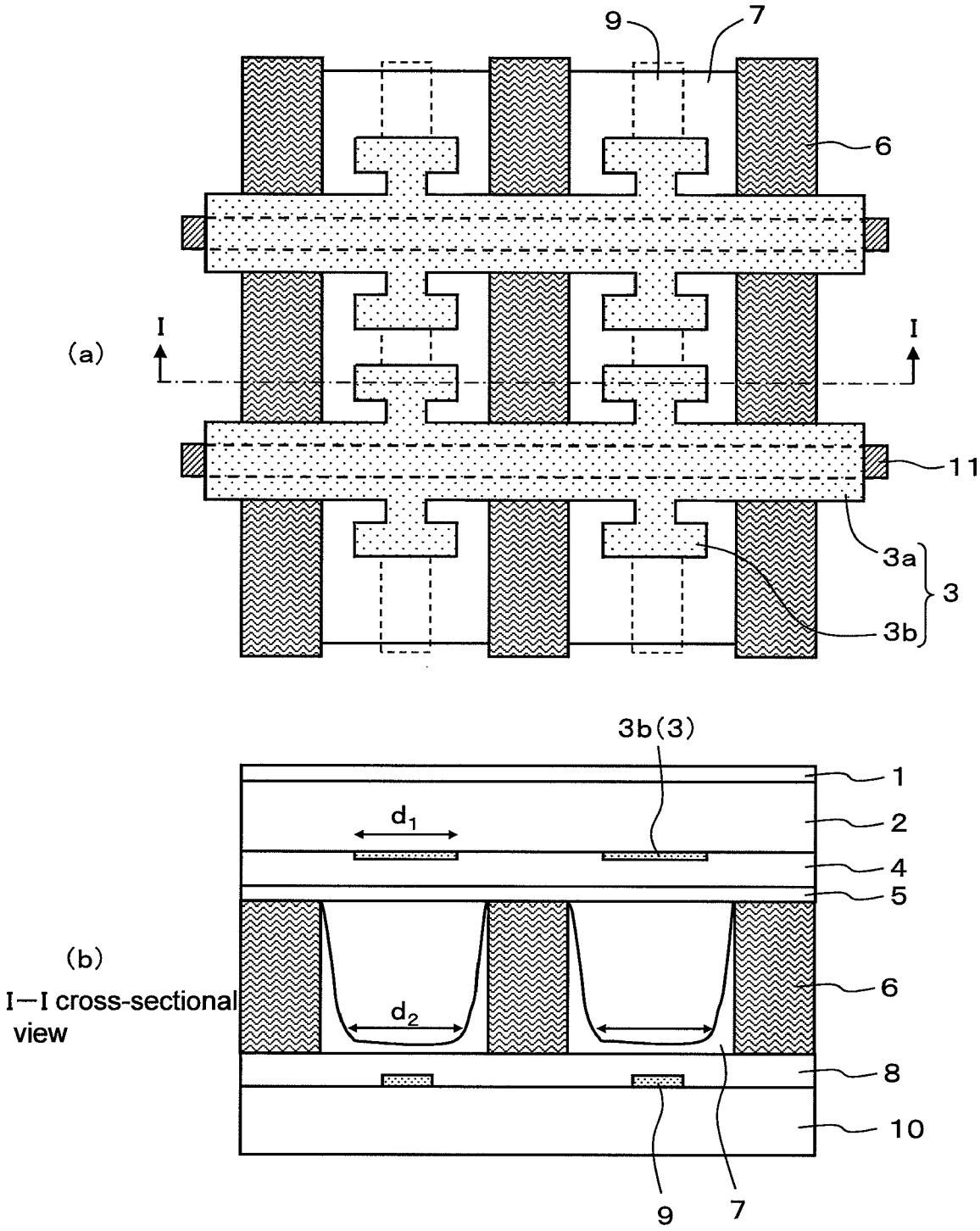
FIG. 4(*a*) is a plan view illustrating a configuration of PDP in accordance with another embodiment of the present invention, and FIG. 4(*b*) is an I-I cross-sectional view of FIG. 4(*a*).

In FIG. 2(*a*), the projection 3*b* has a rectangular-stripe shape; however, the shape of the projection 3*b* may be a T-shape as shown in FIG. 4(*a*), or may have another shape. Accordingly, in the structure shown in FIG. 4(*a*), the width of the tip portion of the projection 3*b* corresponds to "the width of the projection of the display electrode."

Figure 5:
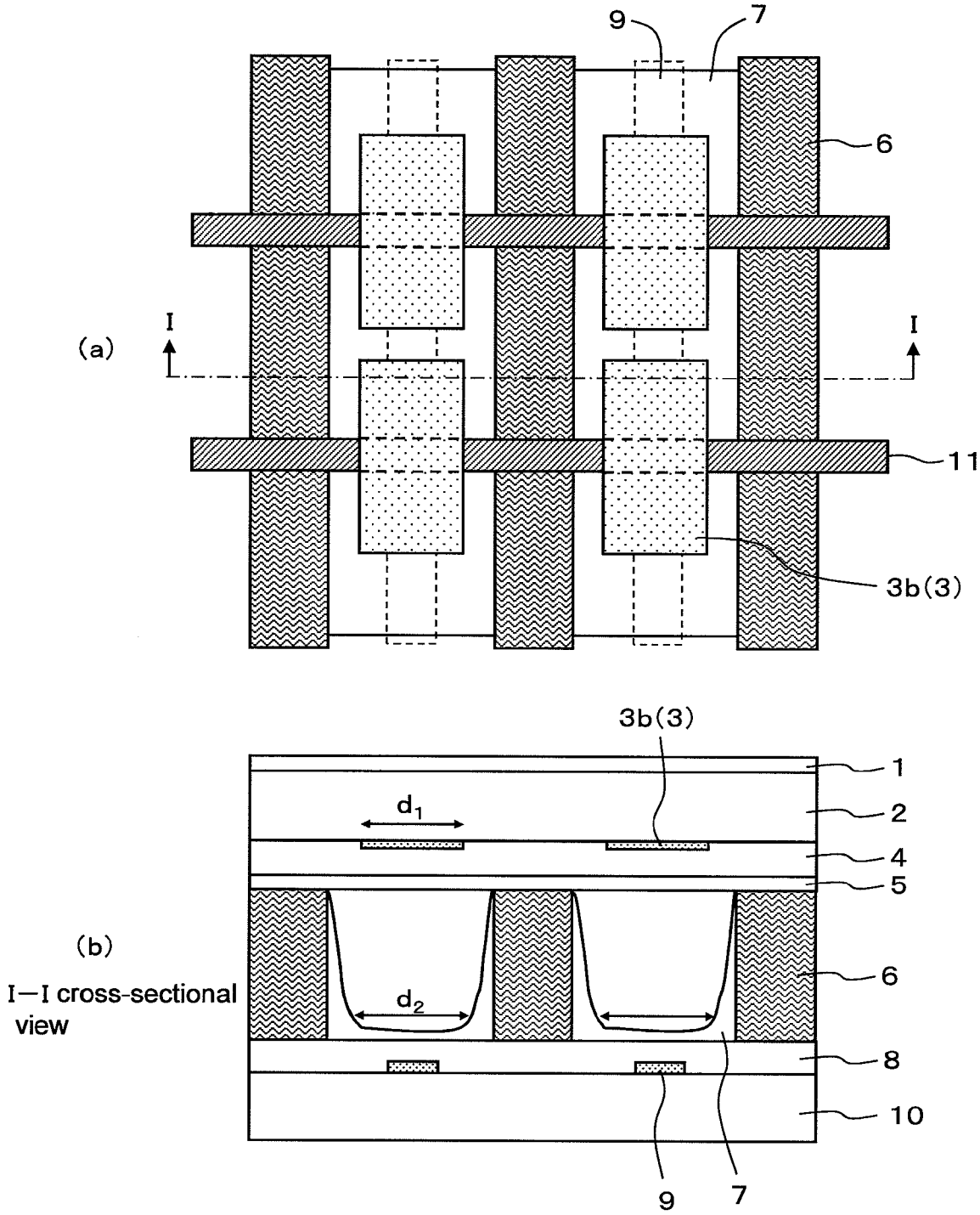
FIG. 5(*a*) is a plan view illustrating a configuration of PDP in accordance with still another embodiment of the present invention, and FIG. 5(*b*) is an I-I cross-sectional view of FIG. 5(*a*).

Moreover, as shown in FIG. 5(*a*), by omitting the base portion 3*a* of the translucent electrode 3, individual projections 3*b* may be directly connected to the belt-like metal electrode 11. In the case of this structure, the metal electrode 11 corresponds to "the base portion of the display electrode", and the projection 3*b* of the translucent electrode 3 corresponds to "the projection of the display electrode."

Figure 6:
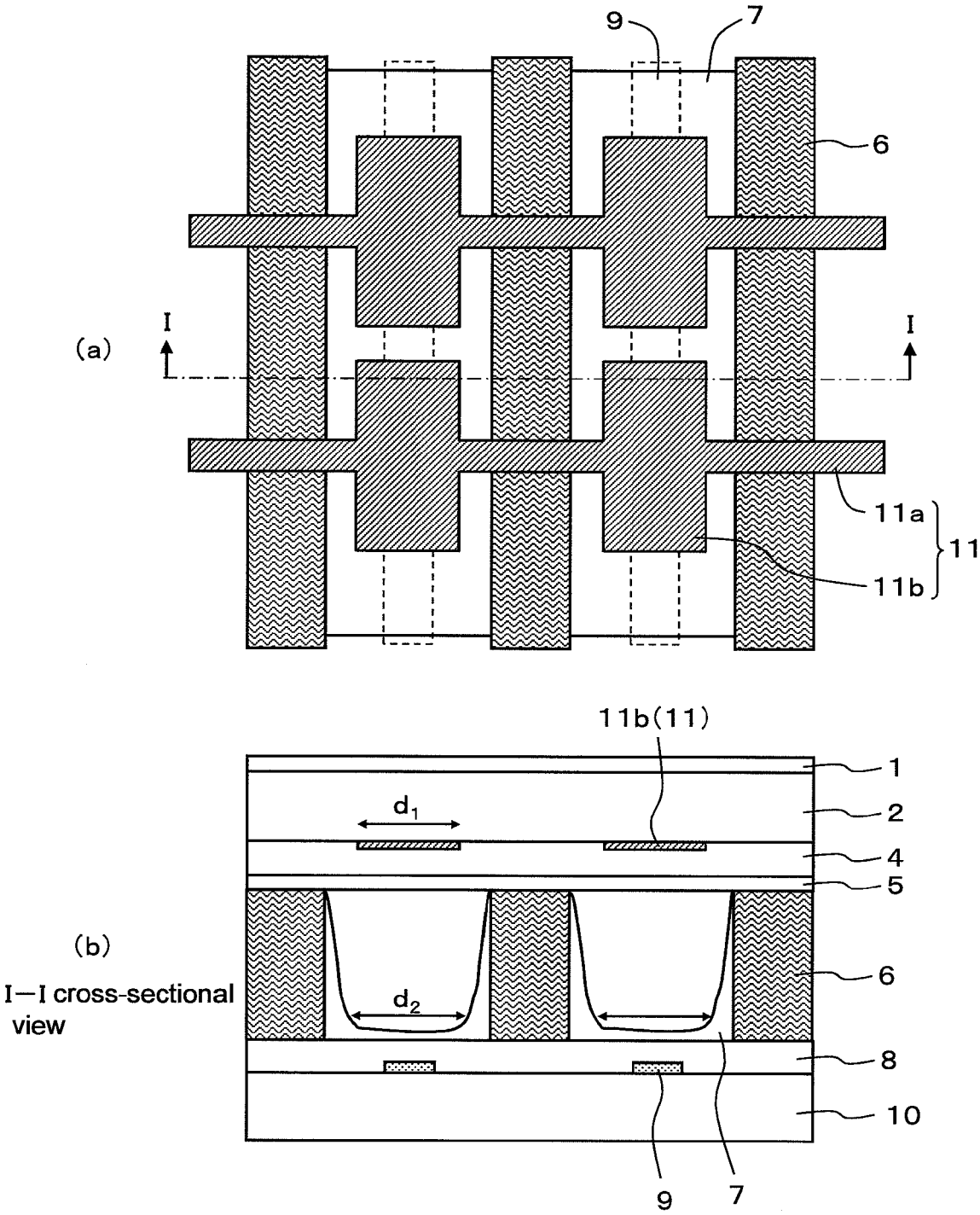
FIG. 6(*a*) is a plan view illustrating a configuration of PDP in accordance with another embodiment of the present invention, and FIG. 6(*b*) is an I-I cross-sectional view of FIG. 6(*a*).

Moreover, as shown in FIGS. 6(*a*) and 6(*b*), by omitting the translucent electrode 3, the band-shaped base portion 11*a* and the projections 11*b* projecting from the base portion 11*a* may be formed by using only the metal electrode 11. In this structure, the base portion 11*a* of the metal electrode 11 corresponds to "the base portion of the display electrode", and the projection 11*b* of the metal electrode 11 corresponds to "the projection of the display electrode."

In the structures of FIG. 5(*a*) and FIG. 6(*a*), the projections 3*b* and 11*b* may be formed into a T-shape or another shape. Moreover, in FIGS. 2(*a*), 4(*a*) and 5(*a*), the metal electrode 11 has a straight shape; however, not particularly limited, the structure of the metal electrode 11 may be formed by, for example, the base portion 11*a* and the projections 11*b* that are extended from the base portion 11*a*. The projection 11*b* may be formed into a rectangular-stripe shape, a T-shape or other shapes.

As described above, various structures of the display electrodes 12X and 12Y are proposed; however, the following description is basically applied to any of the structures of the display electrodes 12X and 12Y.

The width $d_1$ of the projection of the display electrode is the same as or narrower than the width $d_2$ of the bottom of the phosphor layer 7. The ratio $d_1/d_2$ between the width $d_1$ of the projection of the display electrode and the width $d_2$ of the bottom of the phosphor layer 7 is preferably 0.1 to 1, and more preferably 0.5 to 1. More specifically, the ratio $d_1/d_2$ is 0.1, 0.2, 0.3, 0.4, 0.5, 0.6, 0.7, 0.8, 0.9 or 1. The ratio $d_1/d_2$ may be in a range between any two of the numeric values exemplified above.

Moreover, the projection of the display electrode is designed to have a visible light transmittance in a range from 0% or more to 80% or less. More specifically, the visible light transmittance of the projection of the display electrode is, for example, 0, 1, 5, 10, 20, 30, 40, 50, 60, 70, or 80%. The visible light transmittance of the projection of the display electrode may be in a range between any two of the above-mentioned numeric values exemplified above.

The following description will discuss formation methods for the metal electrode 11 and the translucent electrode 3.

The metal electrode 11 is made of, for example, materials such as Ag, Au, Al, Cu, Cr, and laminates thereof (for example, a Cr/Cu/Cr laminate structure) or the like. With respect to Ag and Au, the metal electrode 11 may be formed by a thick film formation technique such as a screen printing method, and with respect to other metals, the metal electrode 11 may be formed by a thin film formation technique such as a vapor deposition method or sputtering method, and an etching technique, so that a predetermined number thereof may be formed in a predetermined thickness, width and interval.

The translucent electrode 3 having a visible light transmittance in a range from 10% or more to 80% or less may be formed, for example, by processes in which, after a transparent conductive material layer made of a transparent conductive material such as ITO and $SnO_2$ has been formed on the front substrate 2, this transparent conductive material layer is subjected to a reduction treatment. The translucent electrode 3 may be formed by a thin film formation technique such as a vapor deposition method or sputtering method, and an etching technique, so that a predetermined number thereof may be formed with a predetermined thickness, width and interval. It has been known that a transparent conductive material such as ITO has a reduced visible light transmittance when a lack of oxygen occurs. Therefore, by heating the transparent conductive material layer under a reducing atmosphere (for example, under a hydrogen atmosphere), or by exposing the transparent conductive material layer to a liquid reducing agent (for example, hydrogen peroxide), a lack of oxygen occurs on the surface of the transparent conductive material layer so that a translucent electrode 3 having a visible light transmittance in a range from 10% or more to 80% or less can be obtained. More specifically, the visible light transmittance of the translucent electrode 3 is, for example, 10, 15, 20, 25, 30, 35, 40, 45, 50, 55, 60, 65, 70, 75 or 80%. The visible light transmittance of the translucent electrode 3 may be in a range between any two of the numeric values exemplified above. The visible light transmittance of the transparent conductive material layer is 80% or more to 100% or less. More specifically, the visible light transmittance of the transparent conductive material layer is, for example, 81, 82, 83, 84, 85, 86, 87, 88, 89, 90, 91, 92, 93, 94, 95, 96, 97, 98, 99, or 100%. The visible light transmittance of the transparent conductive material layer may be in a range between any two of the numeric values exemplified above.

Moreover, the translucent electrode 3 is made of a transparent conductive material containing an impurity (for example, metal such as Cr). The impurity is contained so that the visible light transmittance of the translucent electrode 3 is 10% or more to 80% or less. The impurity is preferably prepared as particles. By changing the content of the impurity, the visible light transmittance of the translucent electrode 3 can be changed.

Furthermore, the translucent electrode 3 comprises a transparent conductive material layer and a metal layer laminated on the transparent conductive material layer. The transparent conductive material layer is made of a transparent conductive material, and the metal layer is made of metal such as Cr. The metal layer is formed with such a thickness that the visible light transmittance of the translucent electrode 3 is 10% or more to 80% or less. In a case where the metal layer is extremely thin, since it allows slight light to pass therethrough, the visible light transmittance of the translucent electrode 3 can be changed by changing the thickness of the metal layer. The metal layer may be formed between the transparent conductive material layer and the front substrate 2, or may be formed between the transparent conductive material layer and the dielectric layer 4. The translucent electrode 3 may be formed by processes in which a thin metal layer is formed on the upper portion or the lower portion of a transparent conductive material layer, and the metal film and the transparent conductive material layer are etched by using the same resist mask. In a case where the metal is Cr, in an attempt to allow visible light to transmit the metal layer, the thickness of the metal layer may be set to 35 nm or less.

3. Function for Improving Bright Room Contrast

The following description will discuss a function for improving the bright room contrast by using the PDP of this embodiment.

Figure 7:
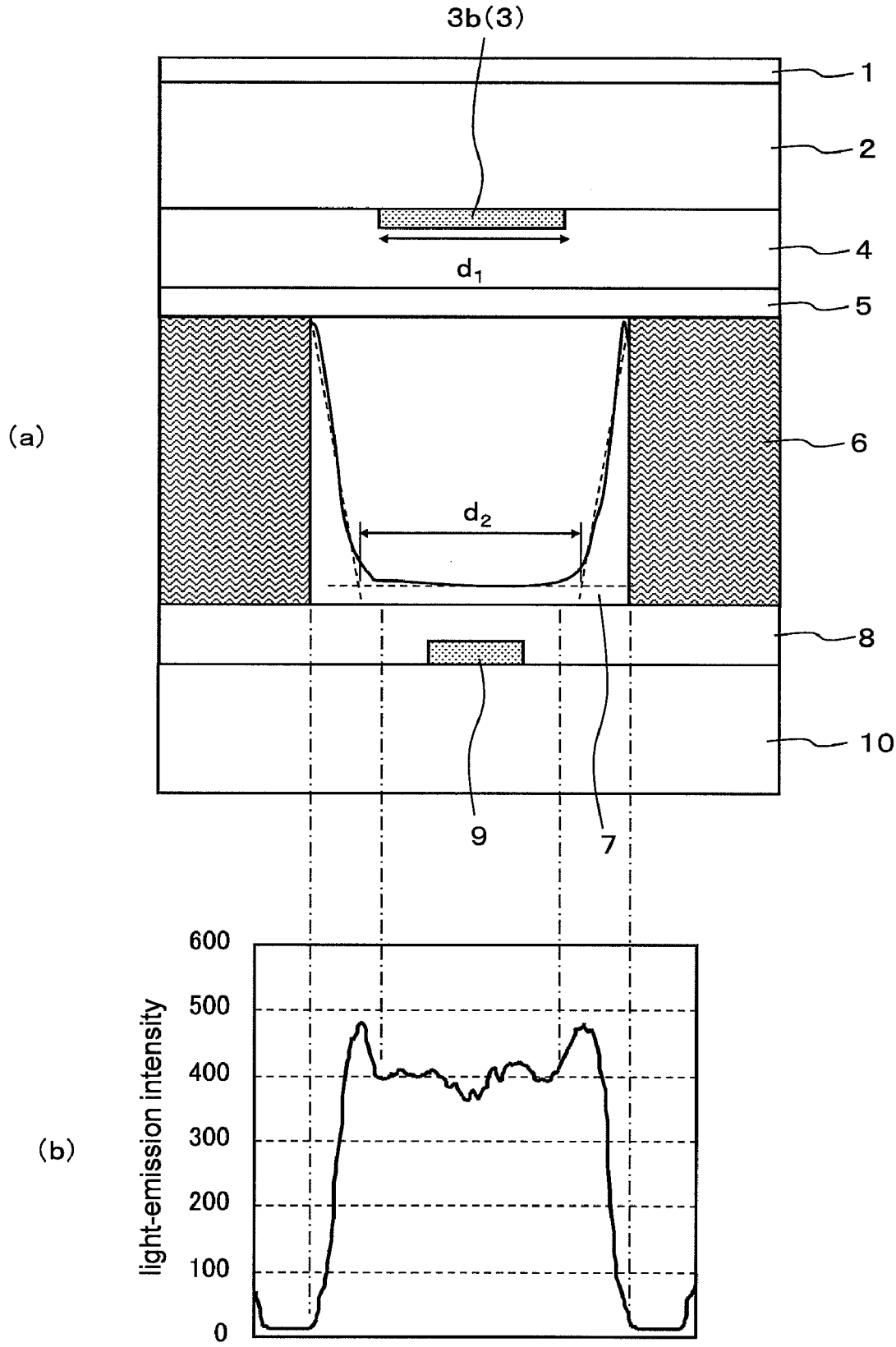
FIGS. 7(*a*) and 7(*b*) are drawings that explain a function for improving bright room contrast by the present invention, FIG. 7(*a*) is a cross-sectional view corresponding to FIG. 2(*b*), and FIG. 7(*b*) illustrates a light-emission intensity profile of a discharge cell.

As shown in FIG. 7, the light emission profile of the discharge cell in a line direction (lateral direction) shows that the light emission intensity is high near the barrier rib and low in the center of the discharge cell. The reflected light of the PDP is mainly composed of externally-incident light reflected light on the phosphor layer. The externally-incident light reflected light is derived from light that is made incident from outside and randomly reflected inside the discharge cell and is then released onto the display surface side; therefore, in the profile of the externally-incident light reflected light, the reflected light intensity is virtually uniform inside the discharge cell. Therefore, by making the width $d_1$ of the projection of the display electrode having a reduced visible light transmittance identical to or narrower than the width $d_2$ of the bottom of the phosphor layer 7, the visible light transmittance is lowered at a portion that is less influential to the luminance so that the externally-incident light reflection on the phosphor layer in the center of the cell is suppressed. More specifically, by setting the visible light transmittance of the projection of the display electrode to 0% or more to 80% or less, which is lower than that of the prior art, the intensity of the externally-incident light reflected light can be greatly lowered than the light emission intensity so that the bright room contrast can be improved. Additionally, the projection of a conventional display electrode made of ITO has a visible light transmittance of about 89%.

Moreover, by increasing the visible light transmittance of the optical filter 1 to be placed on the front side of the front substrate 2, the light emission intensity can be increased, with the intensity of the externally-incident light reflected light being kept in the same level as the prior art structure.

Figure 8:
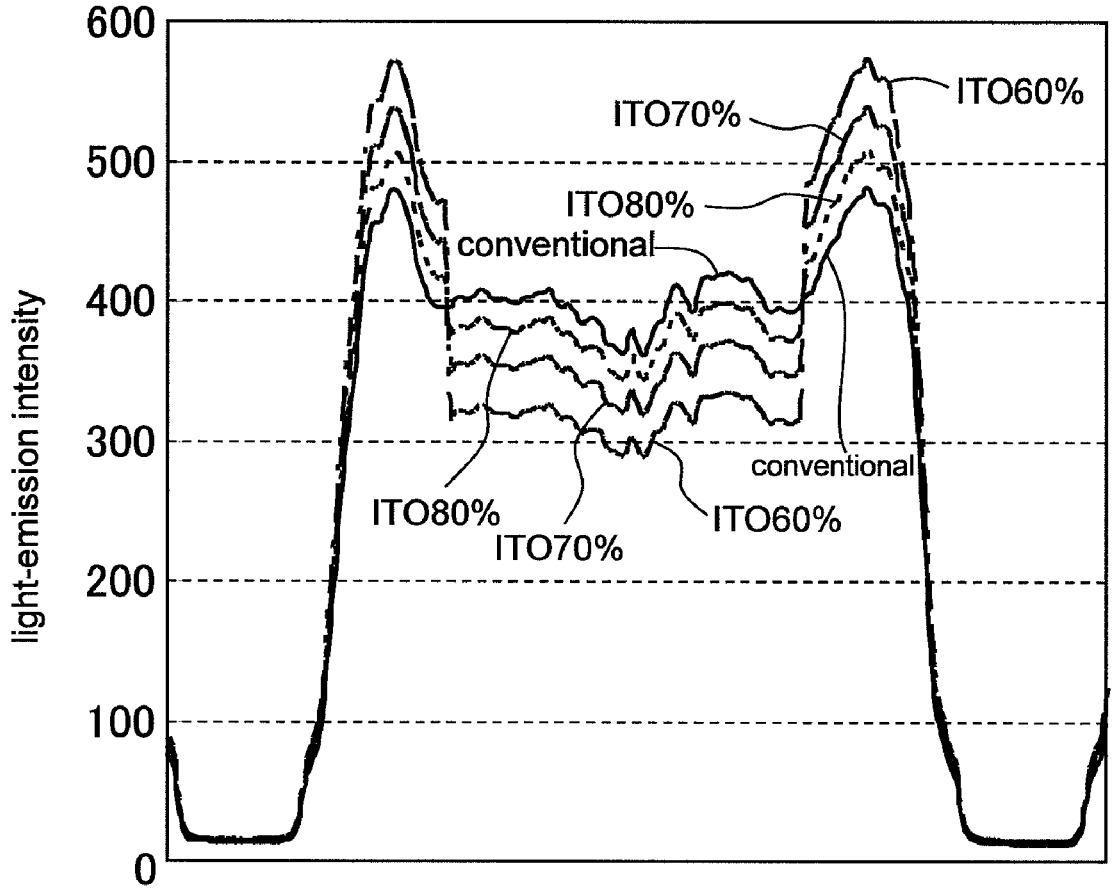
FIG. 8 illustrates a conventional light-emission intensity profile and a light-emission intensity profile that is supposed to be obtained by applying the present invention.

Table 1 summarizes the rate of climb of the light emission intensity in a case where the visible light transmittance of the projection of the display electrode is made lower than the conventional value (89%), with the visible light transmittance of the optical filter 1 being increased, so that the reflected light intensity is made as high as the prior structure. Moreover, FIG. 8 shows profiles of the light emission intensity in a case where the visible light transmittance of the projection of the display electrode is each of the prior art values (89%), 80%, 70% and 60%. In this case, the visible light transmittance of the optical filter 1 is determined on the assumption that the area of the translucent electrode 3 occupies 46.8% within the discharge cell. The rate of climb of the light emission intensity indicates a rate of climb from the light emission intensity under the prior art conditions.

TABLE 1

| Visible light transmittance of projection of display electrode | Visible light transmittance of optical filter | Rate of climb of light emission intensity |
|---|---|---|
| 89% (prior art) | 40.0% (prior art) | — |
| 80% | 42.2% | 3.5% |
| 70% | 44.7% | 7.3% |
| 60% | 47.6% | 11.5% |
| 50% | 50.2% | 15.0% |
| 40% | 52.7% | 18.0% |
| 30% | 55.0% | 20.1% |
| 20% | 56.9% | 21.1% |
| 10% | 58.1% | 20.5% |
| 0% | 58.5% | 18.3% |

With reference to Table 1, it is found that the light emission intensity is increased in comparison with the prior art in any of cases where the visible light transmittance of the projection of the display electrode is in a range from 0 to 80%. Moreover, since the visible light transmittance of the optical filter 1 is set so that the reflected light intensity is made the same as that of the prior art, the reflected light intensity is kept constant under all the conditions in Table 1. As described above, in accordance with this embodiment, since the light emission intensity can be increased without varying the reflected light intensity, it is possible to improve the bright room contrast. Additionally, in this case, the visible light transmittance of the optical filter is set so that the reflected light intensity is not varied; however, for example, the visible light transmittance of the optical filter may be set so that the light emission intensity is not varied. In this case, the reflected light intensity is lowered in comparison with the prior art. Therefore, in this case also, it is possible to improve the bright room contrast. Moreover, for example, the visible light transmittance of the optical filter may be set so as to raise the light emission intensity and also to lower the reflected light intensity.

Furthermore, Table 1 indicates that, even in the case of 0% of the visible light transmittance of the projection of the display electrode, the bright room contrast can be improved by the present invention. Therefore, the present invention can be applicable also to a structure in which the display electrode is made of only the metal electrode.

4. Structure of Plasma Display Module, Gradation-driving Sequence of PDP

Figure 9:
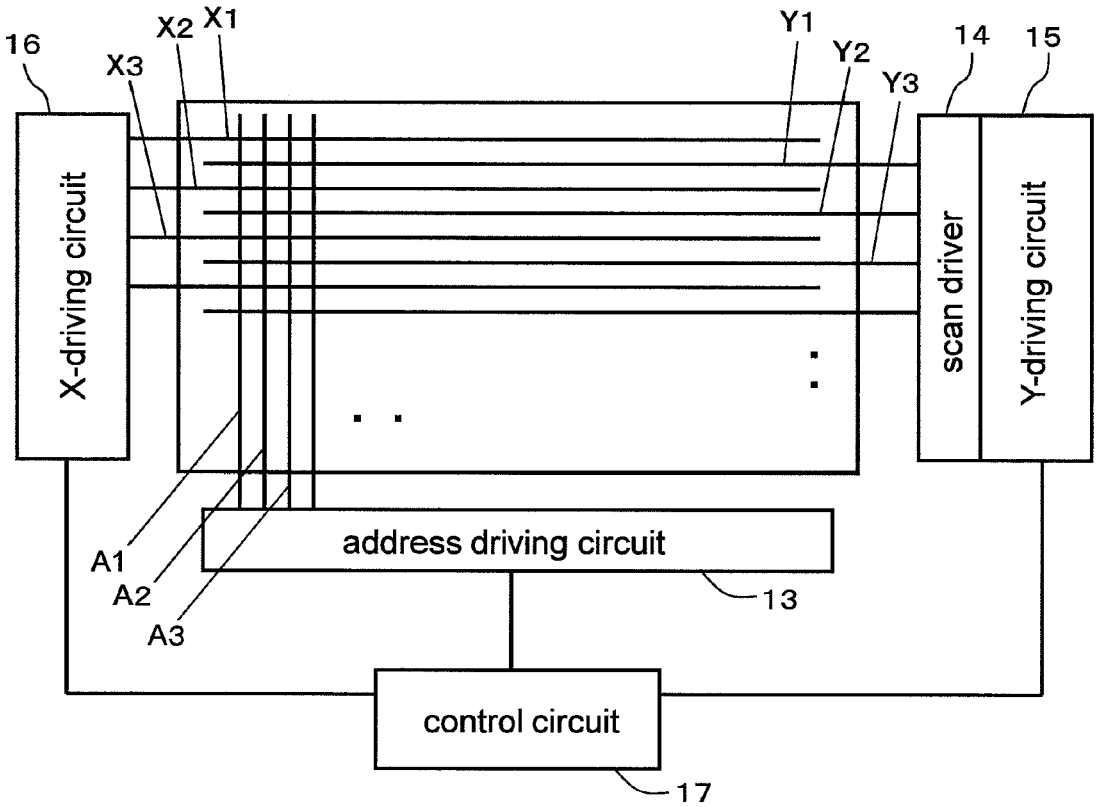
FIG. 9 is a block diagram that schematically shows an entire configuration of one example of a plasma display apparatus.

FIG. 9 shows an entire structure of one example of a plasma display module. The PDP has a structure in which display electrodes (X1, X2, X3, . . . ) that carry out sustain discharging and scanning electrodes (Y1, Y2, Y3 . . . ) are alternately disposed to form display lines, and display cells having a matrix pattern are formed by the display electrodes, the scanning electrodes and address electrodes (A1, A2, A3, . . . ) that perpendicularly intersect with these electrodes. Moreover, the respective electrodes are connected to an address driving circuit 13, a scanning driver 14, a Y-driving circuit 15 and an X-driving circuit 16 so as to apply a voltage to each of the electrodes. Moreover, a control circuit 17 is provided so as to control these circuits.

The scanning driver 14 successively applies a scanning pulse to the scanning electrodes during an addressing process to select scanning electrodes (display line), and generates an address discharge used for selecting the lighting-on/non-lighting-on of the cell between each of the address electrodes connected to the address driving circuit 13 and each of the scanning electrodes. Moreover, the Y-driving circuit 15 and the X-driving circuit 16 generate sustain discharges the number of which corresponds to the weight of each subfield with respect to the cell selected by the address discharge, during a display process. The control circuit 17 outputs a control signal suitable for each of the driving circuits based upon image data and signals inputted from an external device such as a TV tuner and a computer so that a predetermined image displaying operation is carried out.

Figure 10:
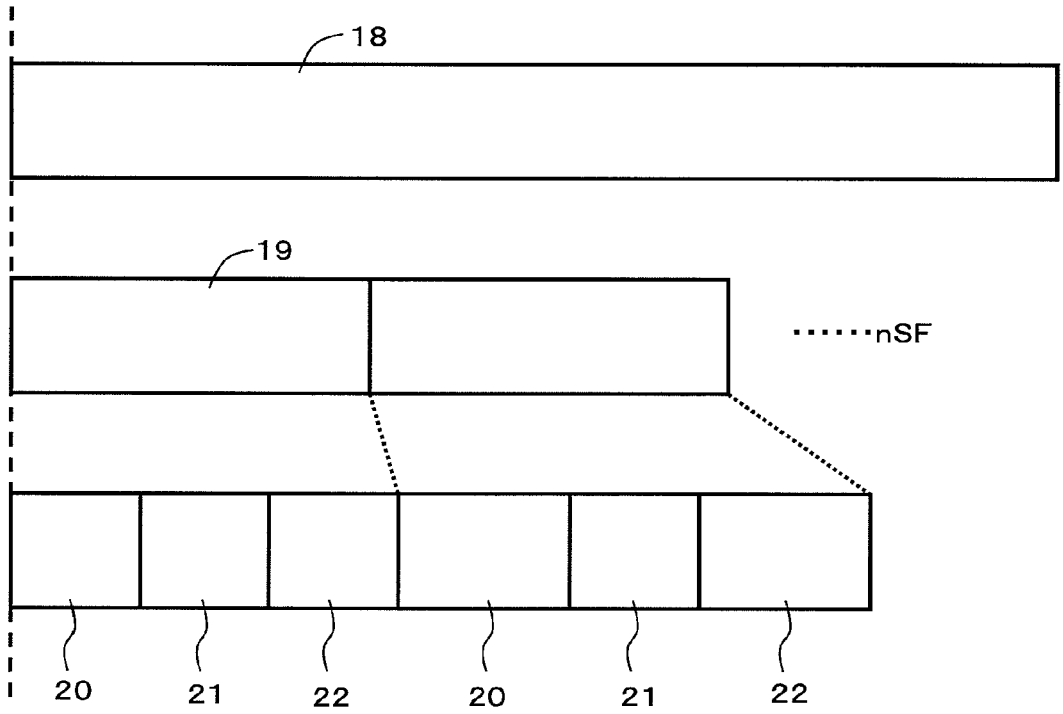
FIG. 10 is a drawing that shows an example of a gradation driving sequence in the plasma display apparatus.

FIG. 10 is a drawing that shows one example of a gradation-driving sequence in the PDP of FIG. 1.

As shown in FIG. 10, the gradation-driving sequence in the plasma display device is designed so that one field (frame) 18 is constituted by a plurality of subfields 19 (sub-frames) SF1 to SFn having predetermined weights of luminance, and by combining the respective subfields, a predetermined gradation display is carried out. More specifically, with respect to the plurality of subfields, for example, by using eight subfields SF1 to SF8 (the ratios of numbers of sustain discharges are: 1:2:4:8:16:32:64:128) having luminance weights of exponents of 2, a display having 256 gradations is carried out. Needless to say, the number of the subfields and the weights of the respective subfields may be combined in various ways.

Moreover, each subfield is composed of an initializing process (reset period 20) for making wall charges of all the cells in each of display areas uniform, an address process (address period 21) for selecting cells to be lighted on and a display process (sustain discharging period 22) for allowing the selected cell to discharge (to light on) by the number of times in accordance with the luminance (weights of the respective subfields) so that the cells are lighted on in accordance with the luminance for each display of each of the subfields, and, for example, a displaying process of one field is carried out by displaying 8 subfields (SF1 to SF8).

Figure 11:
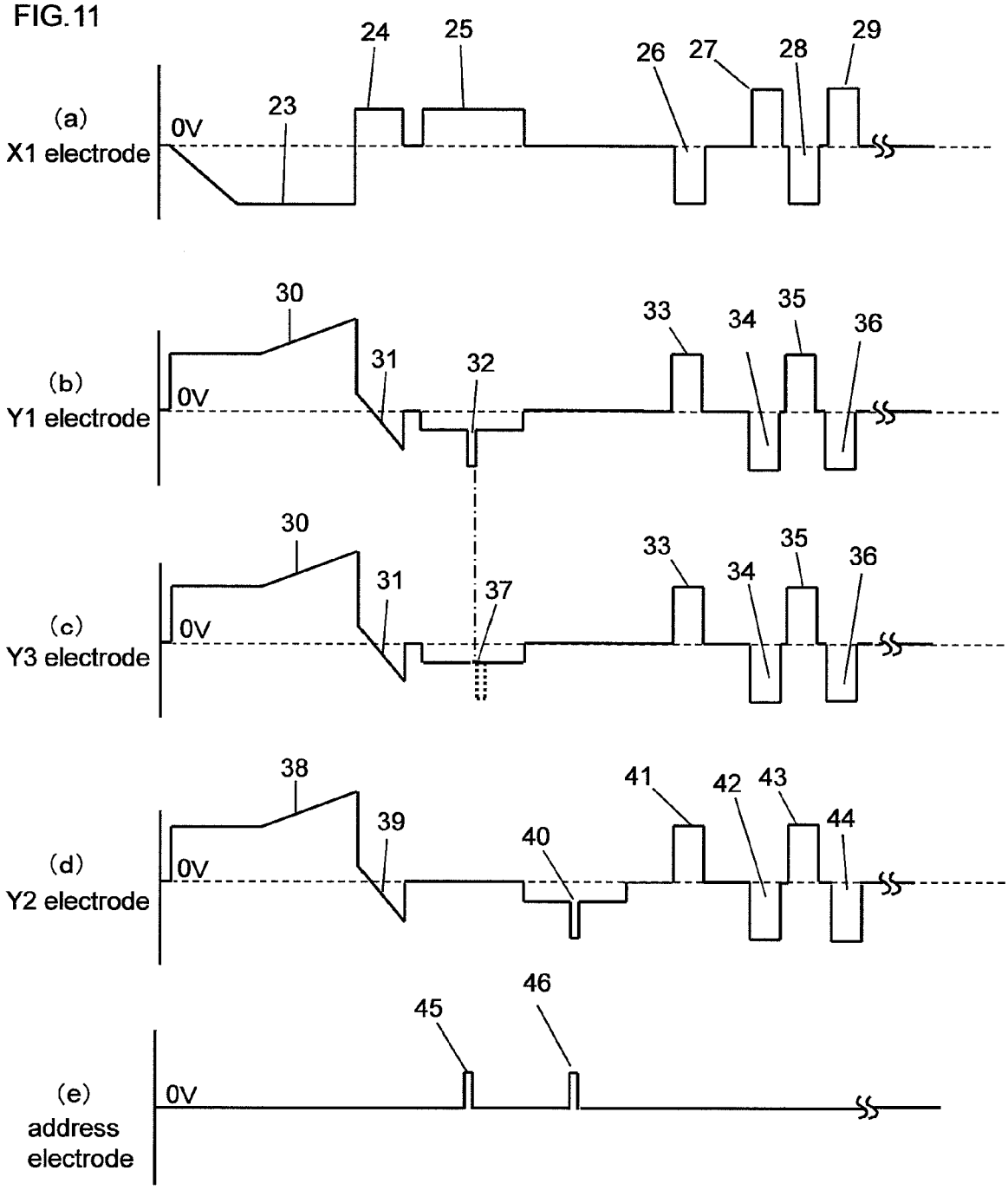
FIG. 11 is a drawing that shows an example of a driving waveform in the plasma display apparatus.

Next, FIGS. 11(*a*) to 11(*e*) show examples of driving waveforms. FIGS. 11(*a*) to 11(*e*) respectively show driving waveforms to be applied to the respective electrodes of X1, Y1, Y3, Y2 and address electrodes from the reset period 20 to the sustain discharging period 22. In this case, each of figures attached to X and Y indicates the number of lines, and the corresponding waveform is used for a discharge given between two electrodes indicated by the same figure. Additionally, Y1, Y3 and Y2 are examples typically representing the odd line and even line of Y.

First, to the X1 and Y1 electrodes of FIGS. 11(*a*) and 11(*b*), a Y-writing dull waveform 30 and an X voltage 23 are applied so as to form wall charges on the entire cells. Successively, a Y-compensation dull waveform 31 and an X compensation voltage 24 are applied thereto so as to erase the wall charges formed inside the cells, with required amounts of the wall charges being left.

Voltage waveforms to be applied in the next address period 21 correspond to a scanning pulse 32 for allowing the odd line to discharge so as to determine cells to display the line direction and an X voltage 25 used for forming a charge by this discharge. This scanning pulse 32 is applied with its timing being offset for each of the lines. In the succeeding sustain discharging period 22, first sustain pulses 26 and 33, and repetitive sustain pulses 27, 28, 29, 34, 35 and 36 are applied.

FIG. 11(*c*) shows a voltage waveform to be applied to the Y3 electrodes, which is the same as the voltage waveform to be applied to the Y1 electrodes shown in FIG. 11(*b*) except for the timing for the scanning pulse 37. Supposing that no cells on the line of Y3 electrodes are lighted on, no scanning pulse 37 is required and can be omitted. Thus, the driving time can be shortened. At this time, voltages are not applied to all the address electrodes, and these can be omitted in the same manner. Since the voltage applied to the display electrodes has a constant value, the driving time can be easily shortened in the same manner.

In the reset period 20, a Y-writing dull waveform 38 is applied to the Y2 electrodes of FIG. 11(*d*) so as to form charges on the entire cells. Successively, a Y-compensation dull waveform 39 is applied thereto so as to erase the charges formed inside the cells, with required amounts of the charges being left.

A voltage waveform to be applied in the next address period 21 corresponds to a scanning pulse 40 for allowing the even line to discharge so as to determine cells to display the line direction. This scanning pulse 40 is also applied with its timing being offset for each of the lines. In the succeeding display period 22, a first sustain pulse 42, and repetitive sustain pulses 42, 43, as well as an adjusting pulse 44 for the number of discharges, are applied.

Voltage waveforms to be applied to the address electrodes 9 of FIG. 11(*e*) in the address period correspond to address pulses 45, 46 for carrying out discharges to determine cells to display the column direction. Additionally, the address pulse is applied in such a timing that the cells to be displayed, located at the intersection points between the scanning electrodes and the address electrodes 9, are allowed to generate a discharge, in association with the scanning pulse to be applied to each line.

In addition to the driving waveforms, a voltage waveform used for erasing wall charges may be applied at the end of the display period 22, if necessary.

INDUSTRIAL APPLICABILITY

The PDP of the present invention can be applied to various types of plasma display apparatuses, and, for example, widely utilized for plasma display apparatuses, such as display apparatuses for personal computers and work stations, plane type wall televisions, or devices for displaying advertisements, information and the like.

The invention claimed is:

1. A plasma display panel provided with a discharge space formed between a front-side substrate assembly and a rear-side substrate assembly, wherein the front-side substrate assembly has a plurality of the display electrodes for defining lines of a screen, and the rear-side substrate assembly has a plurality of barrier ribs for partitioning the discharge space in a column direction, and a phosphor layer that is applied to side surfaces and a bottom surface of each of grooves formed between the barrier ribs, the plasma display panel is characterized in that each of the display electrodes for defining the lines comprises a belt-like metal electrode that extends over an entire length of the screen in a line direction, and a plurality of the translucent electrodes that projects from the metal electrode toward another display electrode adjacent thereto, each translucent electrode has a width the same as or narrower than a width of a bottom of the phosphor layer, has a visible light transmittance ranging from 10% to 80% inclusive, and is formed by reducing a patterned transparent conductive material layer.

2. A plasma display panel provided with a discharge space formed between a front-side substrate assembly and a rear-side substrate assembly, wherein the front-side substrate assembly has a plurality of display electrodes for defining lines of a screen, and the rear-side substrate assembly has a plurality of barrier ribs for partitioning the discharge space in a column direction, and phosphor layer that is applied to side surfaces and a bottom surface of each of the grooves formed between the barrier ribs, the plasma display panel is characterized in that each of the display electrodes for defining the lines comprises a belt-like metal electrode extends over an entire length of the screen in a line direction, and a plurality of translucent electrodes that projects from the metal electrode toward another display electrode adjacent thereto, each translucent electrode has a width the same as or narrower than a width of a bottom of the phosphor layer, has a visible Light transmitting ranging from 10% to 80% inclusive, and is made of a transparent conductive material containing an impurity, the impurity being contained therein so that the visual light transmittance of the translucent electrode ranges from 10% to 80% inclusive.

3. A plasma display panel provided with a discharge space formed between a front-side, substrate assembly and a rear-side substrate assembly, where the front-side substrate assembly has a plurality of display electrodes for defining lines of a screen, and the rear-side substrate assembly has a plurality of barrier ribs for partitioning the discharge space in a column direction, and a phosphor layer that is applied to side surfaces and a bottom surface of each of grooves formed between the barrier ribs, the plasma display panel is characterized in that each of the display electrodes for defining the lines comprises a belt-like metal electrode that extends over an entire length of the screen in a line direction, and a plurality of translucent electrodes that projects from the metal electrode toward another display electrode adjacent thereto, each translucent electrode has a width the same as or narrower than the width of a bottom of the phosphor layer, has a visible light transmittance ranging from 10% to 80% inclusive, and is provided with a transparent conductive material layer and a metal layer laminated on the transparent conductive material layer, the metal layer having a thickness that allows the visual light transmittance of the translucent electrode to range from 10% to 80% inclusive.

4. The plasma display panel according to claim 1, wherein the front-side substrate assembly is further provided with an optical filter on its front side, which has a visible light transmittance ranging from 30 to 70% inclusive.

5. The plasma display panel according to claim 2, wherein the front-side substrate assembly is further provided with an optical filter on its front side, which has a visible light transmittance ranging from 30 to 70% inclusive.

6. The plasma display panel according to claim 3, wherein the front-side substrate assembly is further provided with an optical filter on its front side, which has a visible light transmittance ranging from 30 to 70% inclusive.

* * * * *